US007584969B2

(12) United States Patent
Brunelle et al.

(10) Patent No.: US 7,584,969 B2
(45) Date of Patent: Sep. 8, 2009

(54) PAI GOW GAME WITH SUPPLEMENTAL BET

(76) Inventors: Kenneth Brunelle, P.O. Box 82257, Las Vegas, NV (US) 89180; Danny R. Piper, P.O. Box 82257, Las Vegas, NV (US) 89180

( * ) Notice: Subject to any disclaimer, the term of this patent is extended or adjusted under 35 U.S.C. 154(b) by 217 days.

(21) Appl. No.: 11/788,222

(22) Filed: Apr. 19, 2007

(65) Prior Publication Data

US 2007/0170653 A1 Jul. 26, 2007

Related U.S. Application Data

(60) Provisional application No. 60/899,268, filed on Feb. 2, 2007.

(51) Int. Cl.
*A63F 1/00* (2006.01)

(52) U.S. Cl. ..... 273/292; 273/274

(58) Field of Classification Search ..... 273/292, 273/274, 309; 463/13, 12
See application file for complete search history.

(56) References Cited

U.S. PATENT DOCUMENTS

| | | | | |
|---|---|---|---|---|
| 6,631,906 | B1 * | 10/2003 | Timpano | 273/292 |
| 6,793,220 | B1 * | 9/2004 | Feola | 273/292 |
| 2006/0244218 | A1 * | 11/2006 | Frankel et al. | 273/292 |
| 2007/0111786 | A1 * | 5/2007 | Snow | 463/27 |

* cited by examiner

*Primary Examiner*—Benjamin H Layno
(74) *Attorney, Agent, or Firm*—Howard & Howard Attorneys PLLC

(57) ABSTRACT

The present invention provides a game for play between a player and a dealer including an initial bet, a set of player cards, and a set of dealer cards. The player cards are arranged into at least first and second player hands, while the dealer cards are arranged into at least first and second dealer hands. The player may make elect to make a supplemental bet following arrangement of the player cards but before arrangement of the dealer cards. The initial bet and the supplemental bet are resolved by comparing the player hands with the dealer hands. The present invention also provides a method of playing the game described herein.

6 Claims, 2 Drawing Sheets

PAI GOW GAME WITH SUPPLEMENTAL BET

CROSS-REFERENCE TO RELATED APPLICATIONS

This application claims the benefit and priority of a U.S. Provisional patent application 60/899,268 filed on Feb. 2, 2007, and entitled Method of Playing Pai Gow Poker, which is incorporated herein by reference in its entirety.

FIELD OF THE INVENTION

The present invention is directed to a game of chance, and more particularly to a pai gow-type card game having a supplemental bet.

BACKGROUND OF THE INVENTION

Casino card games wherein a player receives a plurality of cards which are then divided into at least two hands are known in the art. One such game is pai gow poker. In pai gow, a player is dealt seven cards after posting an initial bet, which the player then arranges into a two-card "low" hand and a five-card "high" hand. The strength of each hand is determined using standard poker rankings, with two aces being the best low hand, and a royal flush being the best high hand. The player may divide his seven cards into any combination provided that the player's high hand outranks the player's low hand.

In pai gow, a dealer also receives seven cards which are similarly arranged into the best two-card low hand and five-card high hand. The player's initial bet is resolved by comparing the player's high hand to the dealer's high hand, and comparing the player's low hand to the dealer's low hand. Typically, if the player's high hand and low hand both outrank the dealer's high hand and low hand, i.e., if the player wins both hands, the initial bet is paid evenly. If either the player's high hand or the player's low hand outranks the dealer's high hand or the dealer's low hand, i.e., the player wins one of the two hands, a "push" results, wherein the initial bet is returned to the player. If the dealer's high and low hands outrank the player's high and low hands, such that the player loses both hands, the initial bet is forfeited. Typically a commission of approximately 5% is taken from any amount won by the player. In the event that a dealer's hand and a player's hand are of the same poker rank, the dealer wins.

In a typical pai gow game, there are six player positions and one dealer position for a total of seven positions. After each player posts an initial bet, a random number generator is used to determine which position receives the first set of seven cards. Dealing then continues in a clockwise direction from the selected position. Once all players have divided their cards into a high hand and a low hand, the dealer cards are revealed and arranged according to the rules of the particular establishment. Player hands are then compared to the dealer's hand to resolve the initial bets.

SUMMARY OF THE INVENTION

The present invention provides a game including an initial bet made by a player, a set of player cards and a set of dealer cards. Each set of cards preferably includes seven cards. The player arranges the player cards into at least a first player hand and a second player hand. Preferably the first player hand includes five cards, while the second player hand includes two cards. Similarly, the dealer arranges the dealer cards into a first dealer hand and a second dealer hand. Preferably the first player hand and the first dealer hand each include five cards, while the second player hand and the second dealer hand each include two cards. According to the present invention, the player may elect to make a supplemental bet following arrangement of the set of player cards but prior to arrangement of the dealer cards. The initial bet and the supplemental bet are resolved by comparing the first player hand to the first dealer hand, and by comparing the second player hand to the second dealer hand. Standard poker rankings are preferably used when comparing the hands.

In one aspect of the present invention, the player receives a payout based on the initial bet if the first player hand outranks the first dealer hand and the second player hand outranks the second dealer hand. The initial bet is returned to the player if either the first player hand outranks the first dealer hand or the second player hand outranks the second dealer hand, but not both. The initial bet is remitted if the first dealer hand outranks the first player hand and the second dealer hand outranks the second dealer hand. In this aspect of the present invention, the player receives a payout based on the supplemental bet if the first player hand outranks the first dealer hand and the second player hand outranks the second dealer hand. The supplemental bet is remitted if at least of the first and second dealer hands outrank the corresponding first and second player hands.

In another aspect of the present invention, if a player elects not to make the supplemental bet, the player receives a payout based on the initial bet only if both the first and second player hands outrank the corresponding first and second dealer hands. The initial bet is remitted if either the first or second dealer hand outranks the corresponding player hand. In this aspect of the present invention, if the player does choose to make the supplemental bet, the player receives a payout on at least one of the initial bet and the supplemental bet if both the first and second player hands outrank the first and second dealer hands. If either the first player hand outranks the first dealer hand or the second player hand outranks the second dealer hand, but not both, at least one of the initial bet and the supplemental bet are returned to the player. If both dealer hands outrank both player hands, both the initial bet and the supplemental bet are remitted.

In yet another aspect of the present invention, the supplemental bet is compulsory. The payout based on the initial bet may be approximately equal to the initial bet, while the payout based on the supplemental bet may be approximately equivalent to the supplemental bet. Either of the payouts may be subject to a commission.

The present invention also provides a method of playing a game having a player and a dealer. First, an initial bet is wagered by the player. Next, a set of player cards are dealt to the player and a set of dealer cards are dealt to a dealer. The player cards are arranged into at least a first player hand and a second player hand. The player then wagers a supplemental bet. Next, the dealer cards are arranged into at least a first dealer hand and a second dealer hand. The first player hand is compared to the first dealer hand, and the second hand is compared to the second dealer hand. Preferably, standard poker rankings are used when comparing hands. The initial bet and/or the supplemental bet are resolved based on the hand comparison. In one aspect of the method of the present invention, a payout is awarded to the player based on the initial bet if both player hands outrank both dealer hands, the initial bet is returned to the player if only one of the player hands outrank the corresponding dealer hand, and the initial bet is remitted if both dealer hands outrank both player hands. A payout may be awarded based on the supplemental bet if both player hands outrank both dealer hands, with the supplemental bet being remitted if either of the dealer hands beat the respective player hand. In another aspect of the method of the present invention, if the player elects not to make the supplemental bet, a payout is awarded based on the initial bet only if both player hands outrank both dealer hands, with the initial bet being remitted otherwise. However, if the player does elect to make the supplemental bet, a payout is awarded based on at least one of the initial bet and the supplemental bet if both player hands outrank both dealer hands, with at least one of the initial bet and the supplemental bet being returned to the player if either of the dealer hands outrank either of the player hands. Both the initial bet and the supplemental bet are remitted if both dealer hands outrank both player hands.

BRIEF DESCRIPTION OF THE DRAWING

The above features and advantages and other features and advantages of the present invention are readily apparent from the following detailed description of the best modes for carrying out the invention when taken in connection with the accompanying drawings, wherein.

DESCRIPTION OF THE PREFERRED EMBODIMENTS

Figure 1:
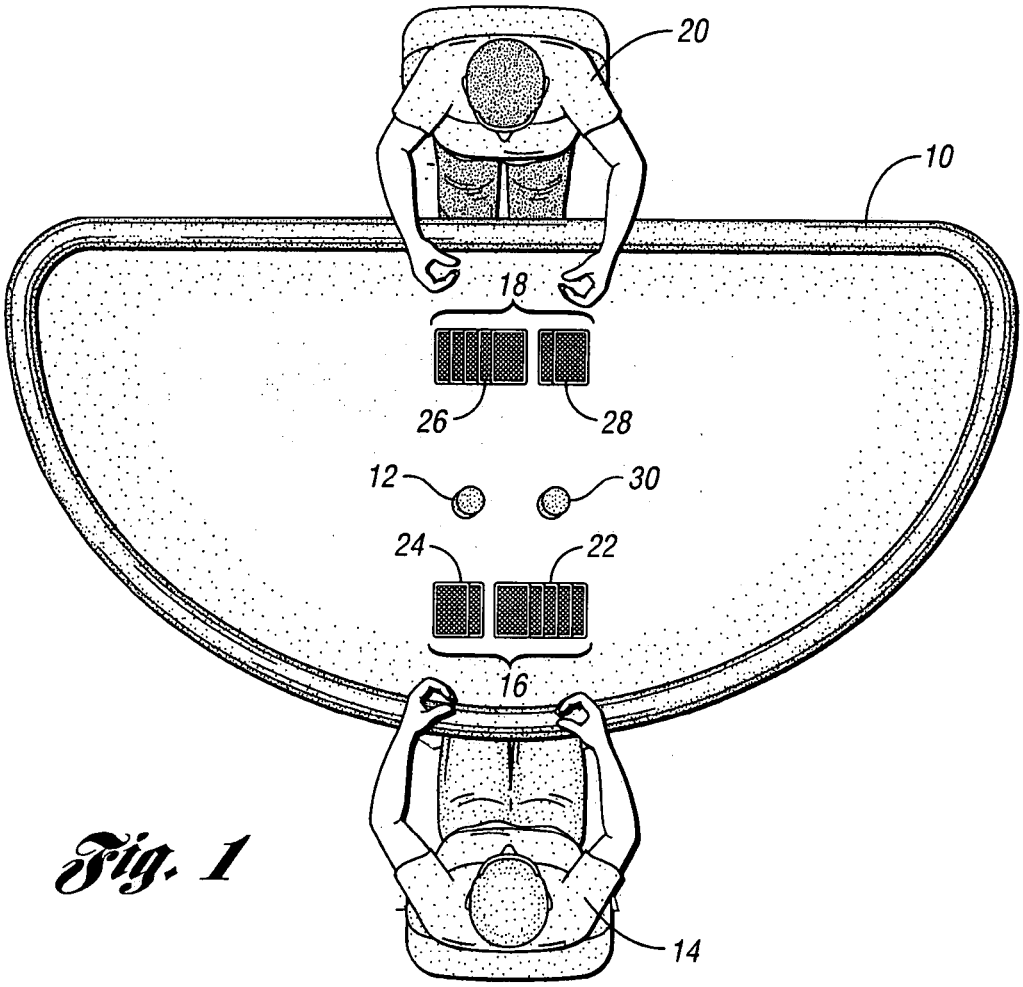
FIG. 1 is a schematic of a game table for use with a game according to the present invention.

Referring to the drawings, wherein like numerals equal like parts, FIG. 1 is a schematic of a game table 10 for use with a game according to the present invention. The game includes an initial bet 12 made by a player 14. A set of player cards 16 are then dealt to the player 14, with a set of dealer cards 18 being dealt to a dealer 20. Each set of cards 16, 18 preferably includes seven cards, as in a traditional pai gow-type poker game. However, each set of cards may include any number of cards within the scope of the present invention. Additionally, while the term "cards" is used herein, the present invention may be practiced using any type of symbol. As one example, sets of tiles may be distributed instead sets of cards.

The player cards 16 are arranged into a first player hand 22 and a second player hand 24. The dealer cards 18 are similarly arranged into a first dealer hand 26 and a second dealer hand 28. The cards 16, 18 may be arranged in any manner within the scope of the present invention. However, in the preferred embodiment of the present invention, as with traditional pai gow-type poker, the first player hand 22 must outrank the second player hand 24, while the first dealer hand 26 must similarly outrank the second dealer hand 28. Additionally, each establishment running a game according to the present invention may set site-specific rules regarding how the dealer 20 must arrange the dealer cards 18. Preferably, the number of cards in the first player hand 22 is equivalent to the number of cards in the first dealer hand 26, while the number of cards in the second player hand 24 is equivalent to the number of cards in the second dealer hand 28. For example, in the preferred embodiment, the first player hand 22 and the first dealer hand 26 each include five cards, with the second player hand 24 and the second dealer hand 28 each including two cards. However, the first and second player and dealer hands 22, 24, 26, 28 may include any number of cards without compromising the inventive concept. Additionally, each set of cards 16, 18 may be arranged into more than two hands within the scope of the present invention.

According to the present invention, the player 14 may elect to make a supplemental bet 30 following arrangement of the player cards 16 but prior to arrangement of the dealer cards 18. Thus the supplemental bet 30 is made by a player 14 with knowledge of his own player cards 16 but without knowledge of the dealer cards 18. The supplemental bet 30 may be compulsory within the scope of the present invention.

Following arrangement of both the player cards 16 and the dealer cards 18, the initial bet 12 is resolved by comparing the first player hand 22 to the first dealer hand 26 and the second player hand 24 is compared to the second dealer hand 28. This comparison is preferably made using standard poker rankings, but the strength of each hand may be evaluated in another manner within the scope of the present invention. The exact manner of resolution of the initial bet 12, and of the supplemental bet 30, occurs as described herein.

In one aspect of the present invention, the player 14 receives a payout based on the initial bet if the first player hand 22 outranks the first dealer hand 26 and the second dealer hand 24 outranks the second dealer hand 28. For example, assume the first player hand 22 is a straight with the second player hand 24 being a pair of aces, while the first dealer hand 26 is two pair and the second dealer hand 28 is a pair of nines. Using standard poker rankings, the first player hand 22 outranks the first dealer hand 26, since a straight outranks two pair. Similarly, the second player hand 24 outranks the second dealer hand 28, since a pair of aces outranks a pair of nines. Thus, in this scenario, the player 14 would receive a payout based on the initial bet 12. The initial bet 12 is returned to the player 14, i.e., a "push" results, if only one player hand 22, 24 outranks a corresponding dealer hand 26, 28. For example, assume the first player hand 22 is a straight, the second player hand 24 is a pair of twos, the first dealer hand 26 is two pair, and the second dealer hand 28 is a pair of nines. In this scenario, while the first player hand 22 outranks the first dealer hand 26, i.e., a straight outranks two pair, the second player hand 24 does not outrank the second dealer hand 28, since a pair of nines outranks a pair of twos. Thus, a push results, with the initial bet 12 being returned to the player 14. Finally, if both dealer hands 26, 28 outrank both player hands 22, 24, the initial bet 12 is remitted to the establishment, i.e., the "house"; that is, the player 14 loses any money wagered as the initial bet 12 when neither player hand 22, 24 outranks the corresponding dealer hand 26, 28.

In this aspect of the present invention, the supplemental bet 30 acts as a sort of confidence bet. The player 14 receives a payout based on the supplemental bet 30 if both player hands 22, 24 outrank both corresponding dealer hands 26, 28. However, the supplemental bet 30 is remitted to the house if even one of the dealer hands 26, 28 outranks the corresponding player hand 22, 24. Thus, the player 14 preferably elects to make the supplemental bet 30 after arranging his cards 16 when he is relatively confident that both of this hands 22, 24 will outrank the corresponding dealer hands 26, 28. If the supplemental bet 30 is compulsory, the player 14 may choose to wager only a minimum supplemental bet 30 if he feels the strength of his hands 22, 24 is not that good. Conversely, if the player 14 is convinced both his hands 22, 24 are winning hands, he may wager a considerable amount as the supplemental bet 30, but risk losing that supplemental bet 30 if either dealer hand 26, 28 outranks the corresponding player hand 22, 24. Preferably, the payout based on the initial bet 12 is approximately equivalent to the initial bet 12; i.e., the initial bet 12 is paid evenly. Similarly, the payout based on the supplemental bet 30 is preferably approximately equivalent to the supplemental bet 30. As in traditional pai gow-type games, the house may take a commission from either payout, with a commission of 5% being preferable. It may be the case that the commission is taken only from the payout on the initial 12. It may also be the case that no commission is taken.

In another aspect of the present invention, if the player 14 elects not to make the supplemental bet 30, the payout based on the initial bet 12 is only awarded if both player hands 22, 24 outrank both dealer hands 26, 28, with the initial bet 12 being remitted to the house if either dealer hand 26, 28 outranks the corresponding player hand 22, 24. Thus the game contemplated by this aspect of the invention is a variation of traditional pai gow-type games, in that no push will result. In this aspect of the present invention, the player 14, after arranging the player cards 16, may elect to make the supplemental bet 30 as an insurance bet. If the insurance bet 30 is made, the game reverts to traditional pai gow-type poker, wherein a push results if only one player hand 22, 24 outranks the corresponding dealer hand 26, 28. By way of example, consider a scenario wherein the first player hand 22 is a straight but the second player hand 28 is jack high, while the first dealer hand 26 is two pair and the second dealer hand 28 is a pair of nines. If the player 14 does not elect to make the supplemental bet 30, the initial bet 12 will be remitted to the house, since the second dealer hand 28 outranks the second player hand 24. However, if the player 14 did elect to make the supplemental bet 30, a push would result, as with a traditional pai gow-type game. Thus in a game according to this aspect of the present invention, the player 14 would be likely to make the supplemental bet 30 if he is unsure whether or not both his hands 22, 24 are winning hands. In the preferred embodiment of the present invention, the insurance bet 30 is remitted to the house in all cases, even if a payout is awarded based on the initial bet 12; that is, by placing the supplemental bet 30 during a game according to this aspect of the invention, the player 14 is paying for assurance that they may be able to push even with low strength hands 22, 24. However, a payout may be awarded based on the insurance bet 30 without changing the inventive concept.

It is important to recognize that the inventive concept underlying both aspects of the present invention described herein lies in the fact that the player 14 has the option of posting a supplemental bet 30 after arranging the player cards 16 but before the dealer cards 18 are revealed. The supplemental bet 30 may be made as a confidence bet or as an insurance bet within the scope of the present invention. It matters only that a player be allowed to make a supplemental bet 30 based on the perceived strength of his hands 22, 24.

Figure 2:
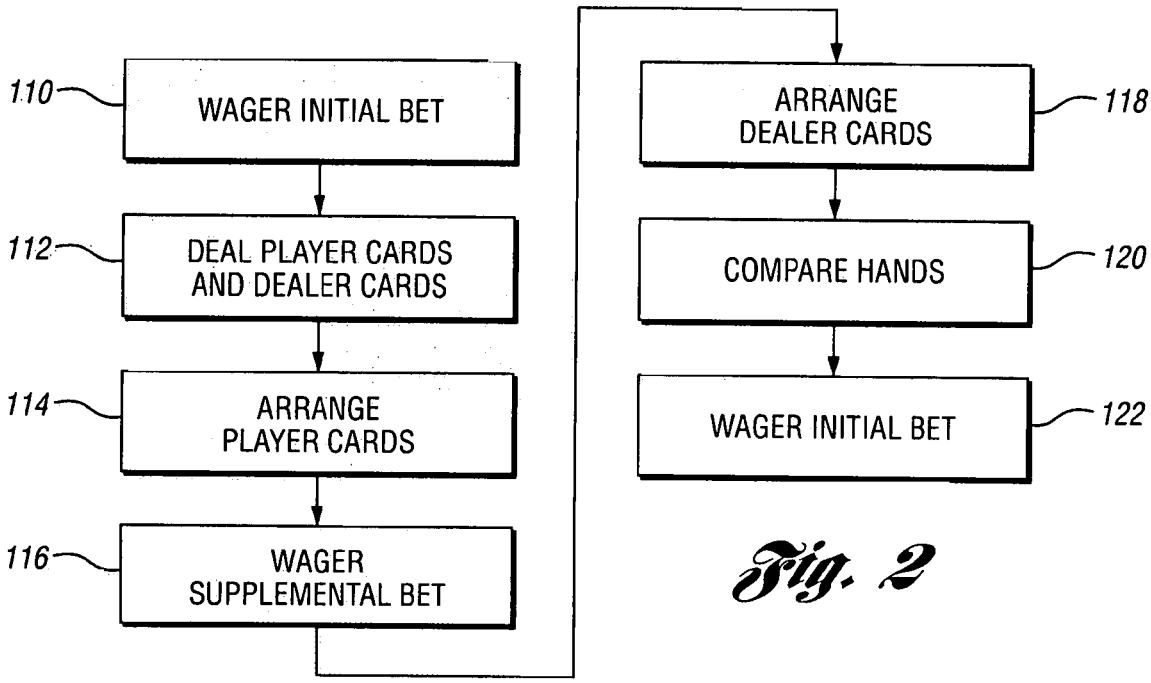
FIG. 2 is a flowchart presenting a method of playing a game according to the present invention.

Turning to FIG. 2, a flowchart presents a method of playing a game having a dealer and a player according to the present invention. First, an initial bet is wagered by the player, as shown in box 110. Next, a set of player cards are dealt to the player and a set of dealer cards are dealt to the dealer, as shown in box 112. In box 114, the set of player cards are arranged into at least a first player hand and a second player hand. Next, a supplemental bet is wagered by the player, as shown in box 116. The supplemental bet may be optional. After the player wagers the supplemental bet, the set of dealer cards are arranged into at least a first dealer hand and a second dealer hand in box 118. In box 122, the first player hand is compared to the first dealer hand, while the second player hand is compared to the second dealer hand using standard poker rankings. Finally, in box 122, at least one of the initial bet and the supplemental bet are resolved based on the comparison.

Figure 3:
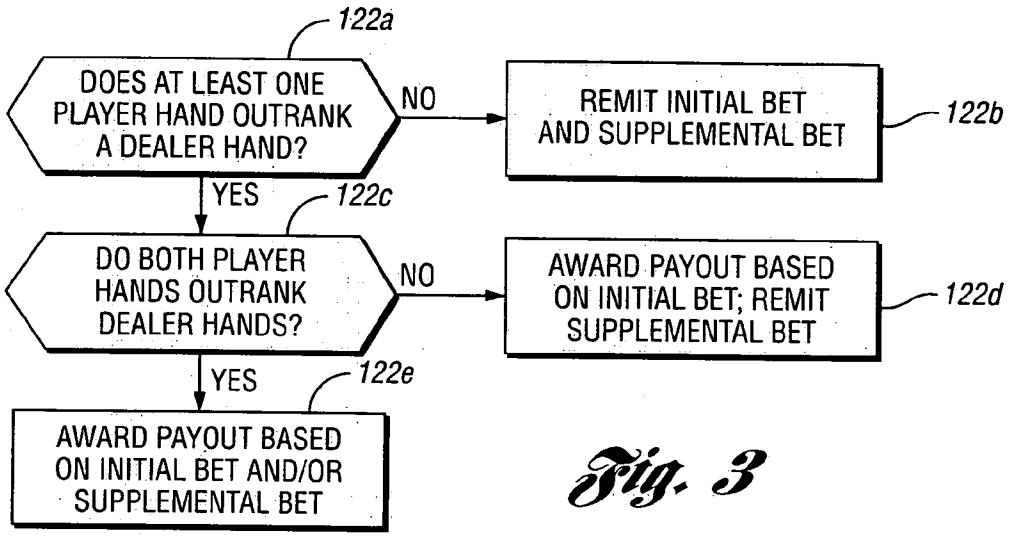
FIG. 3 is a flowchart presenting a first method of resolution of bets made according to the method presented in FIG. 2.
Figure 4:
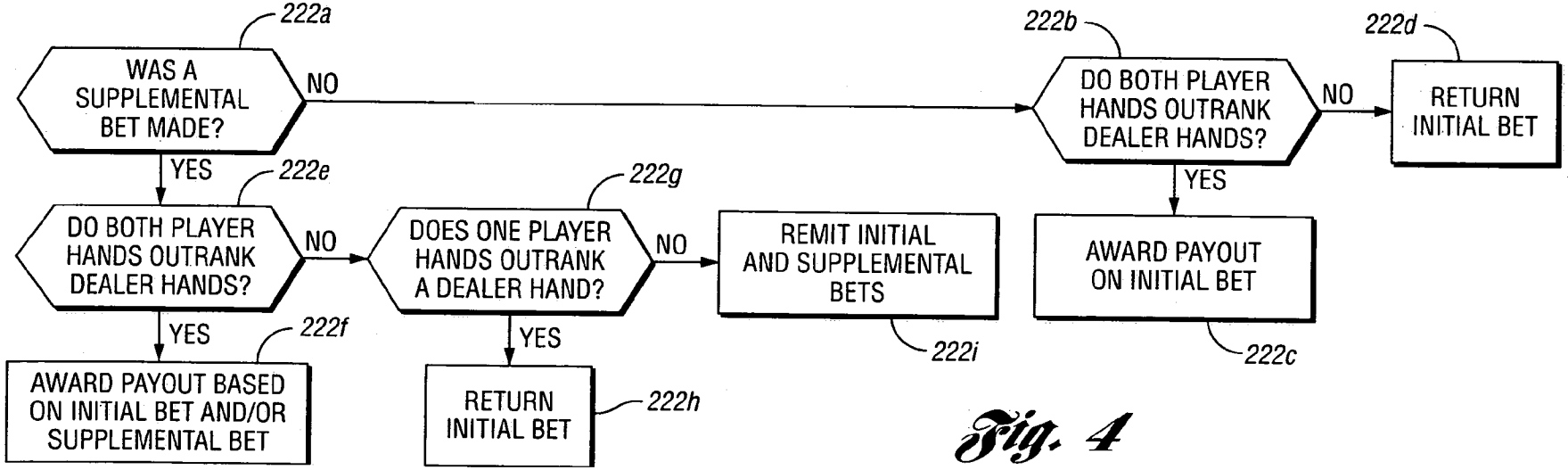
FIG. 4 is a flowchart presenting a second method of resolution of bets made according to the method presented in FIG. 2.

Resolution of each bet may be carried out in different ways within the scope of the method presented herein. FIGS. 3 and 4 delineate the resolution step 122 of the method presented in the flowchart of FIG. 2 according to a differing aspects of the present invention. Turning first to FIG. 3, a first method of resolution is presented. First, box 122*a* asks whether at least one of the player hands outranks the corresponding dealer hand. If the answer is no, both the initial bet and the supplemental bet are remitted to the house in box 122*b*. If the answer is yes, box 122*c* asks whether both the player hands outrank the corresponding dealer hands. If the answer is no, the initial bet is returned to the player while the supplemental bet is remitted to the house in box 122*d*. If the answer is yes, a payout is awarded based on the initial bet and the supplemental bet in box 122*e*.

Turning now to FIG. 4, a second method of resolution is presented. First, box 222*a* asks whether or not a supplemental bet was made. If the supplemental bet was not made, box 222*b* asks whether both of the player hands outranks the corresponding dealer hands. If yes, box 222*c* awards a payout based on the initial bet. If no, the player remits the initial bet to the house in box 222*d*. If the supplemental bet was made, box 222*e* asks whether both player hands outrank both dealer hands. If yes, a payout is awarded based on at least one of the initial bet and the supplemental bet in box 222*f*. The supplemental bet may be an insurance bet, which is always remitted to the house even if a payout is awarded on the initial bet. However, a payout may be awarded based on the supplemental bet within the scope of the present invention. If no, i.e., if at least one dealer hand outranks the corresponding player hand, box 222*g* asks whether one player hand outranks the corresponding dealer hand. If yes, the initial bet is returned to the player in box 222*h*. The supplemental bet may or may not be retained by the house in this scenario within the scope of the present invention. If neither player hand outranks the corresponding dealer hand, i.e., the answer to box 222*g* is no, the player remits both the initial and supplemental bets to the house in box 222*i*.

While the best modes for carrying out the invention have been described in detail, it is to be understood that the terminology used is intended to be in the nature of words and description rather than of limitation. Those familiar with the art to which this invention relates will recognize that many modifications of the present invention are possible in light of the above teachings. It is, therefore, to be understood that within the scope of the appended claims, the invention may be practiced in a substantially equivalent way other than as specifically described herein.

The invention claimed is:

1. A method of playing a game having a player and a dealer comprising:

a) providing a deck of cards and allowing said player to wager of an initial bet;

b) dealing a set of player cards to said player and a set of dealer cards to said dealer;

c) arranging said set of player cards into at least a first player hand and a second player hand;

d) allowing said player to wager a supplemental bet after said set of player cards are arranged;

e) after the step of allowing said player to wager said supplemental bet, arranging said set of dealer cards into at least a first dealer hand and a second dealer hand;

(f) comparing said first player hand to said first dealer hand and said second player hand to said second dealer hand using standard poker rankings;

(g) awarding said player a first payout as a function of said initial bet if: (i) said first player hand outranks said first dealer hand and (ii) said second player hand outranks said second dealer hand;

(h) returning said original bet to said player if either said first player hand outranks said first dealer hand or said second player hand outranks the second dealer hand, but not both;

(i) remitting the original bet if said first dealer hand outranks said first player hand and said second dealer hand outranks said second player hand;

(j) awarding said player a second payout as a function of said supplemental bet if (i) said first player hand outranks said first dealer hand and (ii) said second player hand outranks said second dealer hand; and, (k) remitting said supplemental bet if either or both said first dealer hand outranks said first player hand and said second dealer hand outranks said second dealer hand.

2. The method of claim 1, wherein said wagering of said supplemental bet by said player is optional.

3. The method of claim 2, wherein if said player elects not to make said supplemental bet, said method further includes the step of awarding a payout based on said initial bet to said player if said first player hand outranks said first dealer hand and said second player hand outranks said second dealer hand, and remitting said initial bet if at least one of said first dealer hand outranks said first player hand and said second dealer hand outranks said second player hand.

4. The method of claim 3, wherein if said player elects to make said supplemental bet, said method further includes the step of awarding a payout based on at least one of said initial bet and said supplemental bet if said first player hand outranks said first dealer hand and said second player hand outranks said second dealer hand, returning at least one of said initial bet and said supplemental bet to said player if one of said first player hand outranks said first dealer hand and said second player hand outranks said second dealer hand, and remitting at least one of said initial bet and said supplemental bet if said first dealer hand outranks said first player hand and said second dealer hand outranks said second player hand.

5. The method of claim 1, further including the step of awarding a payout based on said initial bet to said player if said first player hand outranks said first dealer hand and said second player hand outranks said second dealer hand, returning said initial bet to said player if one of said first player hand outranks said first dealer hand and said second player hand outranks said second dealer hand, and remitting said initial bet if said first dealer hand outranks said first player hand and said second dealer hand outranks said second player hand.

6. The method of claim 5, further including the step of awarding a payout based on said supplemental bet to said player if said first player hand outranks said first dealer hand and said second player hand outranks said second dealer hand, and remitting said supplemental bet if at least one of said first dealer hand outranks said first player hand and said second dealer hand outranks said second player hand.

* * * * *